US006123631A

United States Patent [19]

Ginder

[11] Patent Number: 6,123,631

[45] Date of Patent: Sep. 26, 2000

[54] ON-OFF LIGHTED ARCHERY ARROW NOCK APPARATUS

[76] Inventor: Jeffery Allen Ginder, 2827 Uranus Ave., Eau Claire, Wis. 54703

[21] Appl. No.: 09/370,279

[22] Filed: Aug. 9, 1999

[51] Int. Cl.[7] ..... F42B 6/04

[52] U.S. Cl. ..... 473/570; 473/578

[58] Field of Search ..... 362/253; 473/570, 473/578, FOR 216

[56] References Cited

U.S. PATENT DOCUMENTS

| | | | |
|---|---|---|---|
| 4,340,930 | 7/1982 | Carissimi | 362/204 |
| 4,856,792 | 8/1989 | Hardison | 473/570 |
| 4,989,881 | 2/1991 | Gamble | 473/570 |
| 5,058,900 | 10/1991 | Denen | 473/570 |
| 5,134,552 | 7/1992 | Call et al. | 362/203 |
| 5,141,229 | 8/1992 | Roundy | 473/570 |

*Primary Examiner*—John A. Ricci
*Attorney, Agent, or Firm*—Robert T. Johnson

[57] ABSTRACT

On shooting of archery arrows, there is extreme difficulty in following the flight of an arrow, and further difficulty in finding the spent arrow. To obviate the above difficulties disclosure is made of apparatus assembly of an LED light bulb connected to a battery through a single pole switch, and the LED light bulb butting up to the bottom of the arrow nock and the assembly attached to the fletched end of an arrow and the string of the bow opening the single pole switch to "off" when the arrow is in position for shooting, and on shooting the arrow from the bow the single pole switch is in a closed, or on, position to energize the LED light bulb to give off light through the nock, and as part of the apparatus there is a nock protective cap, and a tongue inside of the protective cap, and the nock protective cap on placing over the apparatus nock and the tongue extending to the single pole switch contact opens the switch to turn to "off".

11 Claims, 7 Drawing Sheets

ON-OFF LIGHTED ARCHERY ARROW NOCK APPARATUS

BACKGROUND OF THE INVENTION

In archery shooting of arrows, there has long been a need for better tracking the flight of the arrow, and further there is a problem of locating the shot arrow whether aimed at a deer, or other target, or the spent arrow landing on the ground or underbrush. To overcome the problem of lost arrows, this invention is to disclose apparatus for an on-off lighted archery arrow, having a switch actuated by string of the archery bow.

Prior art pertaining to this present invention is as follows.

U.S. Pat. No. 5,134,552 to Call for ACCELERATION ACTIVATED ENERGIZING DEVICE. This patent discloses a lighted nock, and the light switch activated by spring action at zero acceleration of the arrow.

U.S. Pat. No. 4,340,930 to Carissimi for LIGHT ASSEMBLY FOR ARCHERS ARROW. This patent discloses a manual switch movable on the body of the arrow to close the circuit.

U.S. Pat. No. 5,058,900 to Denen for GENERAL PURPOSE ILLUMINATOR ASSEMBLY. Disclosure is made of a compressible coil capture spring for the capture end of the battery electrode.

U.S. Pat. No. 4,856,792 to Hardison for ARCHERS ARROW WITH CHEMICAL LIGHT SOURCE. Disclosure is made of a lightstick inserted into a cavity in a transparent plastic arrow nock.

U.S. Pat. No. 5,141,229 to Roundy for ACCELERATION AND DECELERATION ELECTRICAL SWITCH. Disclosure is made of an electrical inertia switch.

U.S. Pat. No. 4,989,881 to Gamble for ILLUMINATED SPORTS PROJECTILE. Disclosure is made of a molding containing components diode, wire pair, and contacts and incorporated into the dart.

None of the above prior art patents anticipate, or collectively make obvious the invention as described below.

SUMMARY OF INVENTION

This invention is to disclose apparatus for controlled on/off lighting of a nock of an archery arrow, when shot from a bow, which light enables the archer to follow the flight of the arrow, and on retrieving the arrow turn the light to "off" by opening the switch contacts in the nock by means of a nock protective cap with a tongue of the cap extending into the nock, single pole switch contact.

OBJECTS OF THE INVENTION

An object of this invention is to disclose apparatus of an assembly of a battery, an LED light bulb and open/closed switch contacts, and the battery end of the assembly mounted in the fletched end of the hollow arrow shaft and a transparent or translucent nock mounted over the LED bulb end at the end opposite of the battery of the apparatus.

Another object of this invention is to disclose apparatus of a bow string actuation of on-off open or closed switch contacts in an arrow nock, Another object of this invention is to disclose apparatus of a bow string to open nock switch contacts, in an arrow nock to provide an off or open switch position connection of an LED bulb to battery connection on mounting an arrow into position, in a bow and the bow string in the arrow nock set for shooting the arrow.

Another object of this invention is to disclose apparatus of a closed switch mounted on the nock of an arrow and on positioning a bow string in the nock on mounting the arrow in the bow, opens the closed switch to off the LED light bulb is not energized.

Another object of this invention is to disclose apparatus of a closed switch mounted on the nock of an arrow, and on positioning a bow string in the nock on mounting the arrow in the bow opens the closed switch to the LED bulb, and on shooting the arrow, the bow string is released from the nock and the switch in the nock is closed to energize and light the LED bulb.

Another object of this invention is to disclose apparatus of a plunger on a micro switch and an LED light bulb mounted on the plunger of the micro switch and the micro switch is in the closed or "on" position as mounted on the fletched end of a hollow arrow shaft and the micro switch is in the open or "off" position on mounting the arrow in the bow, with the bow string in the nock, and pushing the plunger down into the micro switch to the "off" or open switch position.

A further object is to disclose apparatus for controlled lighting of an archery arrow nock of wherein the assembly of the LED light bulb, and closed single pole switch contact mounted in the nock and the battery connected to the single pole switch and to the LED light bulb and the LED light bulb of said assembly butting up to the base of the nock and, a nock protective cap placed over the nock and, a tongue in the nock protective cap extending into the nock to separate the contact of the single pole switch to open said switch, to thus de-energize the LED light bulb, when the arrow is not mounted in the bow.

In the description of this invention the words "closed switch" is to indicate the circuit is energized to the LED light bulb. "Open switch" is to indicate the circuit is not energized to the LED light bulb.

LEGENDS OF DRAWINGS

| LEGEND | DESCRIPTION |
|---|---|
| 1 | BATTERY |
| 2 | LED LIGHT BULB |
| 3, 3' | ELECTRIC LEADS TO SINGLE POLE SWITCH CONTACTS |
| 3", 3'" | SINGLE POLE SWITCH CONTACTS IN NOCK |
| 4 | NOCK ASSEMBLY SHOULDER |
| 5 | NOCK SLOT |
| 6 | BOW STRING |
| 7 | NOCK |
| 8 | NOCK AND LED ASSEMBLY |
| 8' | NOCK-MICRO SWITCH-LED ASSEMBLY |
| 9 | TUBULAR METAL ARROW SHAFT |
| 9' | SOLID SHAFT WOOD ARROW |
| 10 | MICRO SWITCH |
| 11 | PLUNGER OF MICRO SWITCH |
| 12 | FLETCHING |
| 13 | ARROW HEAD |
| 14 | NOCK PROTECTIVE CAP |
| 15 | TONGUE IN NOCK PROTECTIVE CAP |
| 16 | FERRULE |
| 17 | BATTERY HOLDER/POCKET |
| 18 | TOP SPRING FOR BATTERY |
| 19 | BOTTOM SPRING FOR BATTERY |
| 20 | ARROW |

DETAILED DESCRIPTION OF THE INVENTION

Having a lighted nock in an arrow in flight the shooter can better follow the trajectory and the landing of the arrow.

Figure 1:
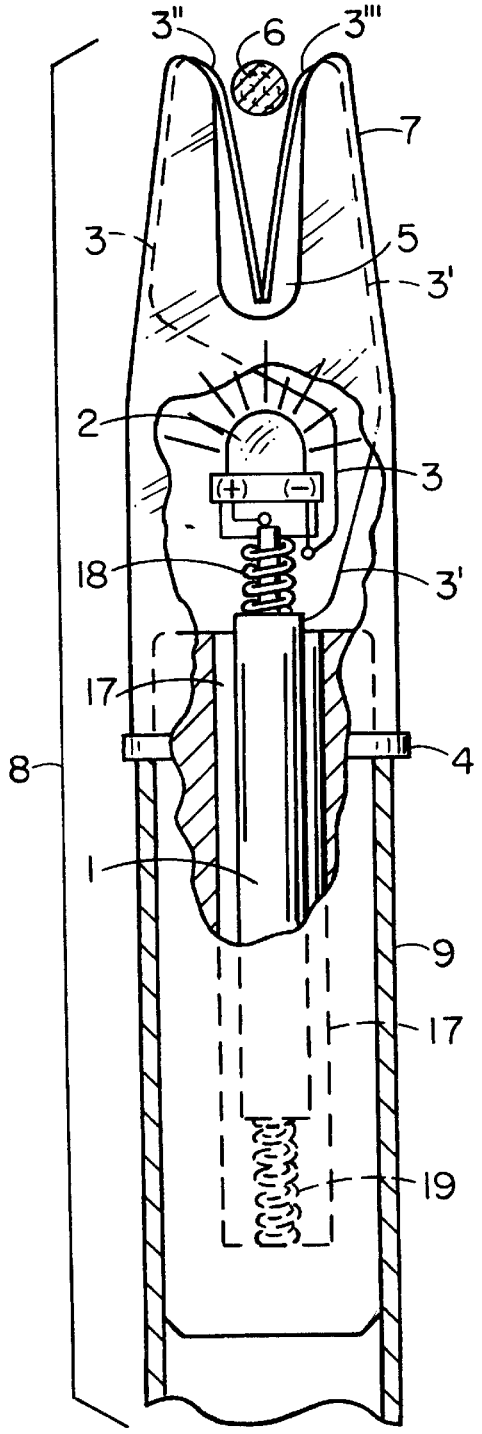
FIG. 1—On-off lighted nock segment apparatus in "on" position or closed switch.

Referring now to FIG. 1, there is shown a lighted nock and LED assembly 8, attached to the tail end or fletching 12 end of tubular metal arrow shaft 9. The single pole switch contacts 3", 3'" attached to the nock slot 5 of nock 7 close the single pole switch to provide power from battery 1 to energize the LED light bulb 2 to an "on" position to give light to the nock 7. The LED light bulb 2 is positioned to abut the bottom of the nock 7, and nock 7 is of transparent or translucent material preferably of plastic or glass and this may be of any color such as red, orange, yellow, or any other color desired. In this FIG. 1, the bow string 6 is shown merely to show the relationship to the nock 7 and single pole switch contacts 3", 3'" attached to electric contact leads 3, 3' in closed switch position. The nock assembly shoulder 4, limits the depth of immersion of the battery holder/pocket 17 into the fletched end of the tubular metal shaft 9 of arrow 20 or into the ferrule 16.

Figure 2:
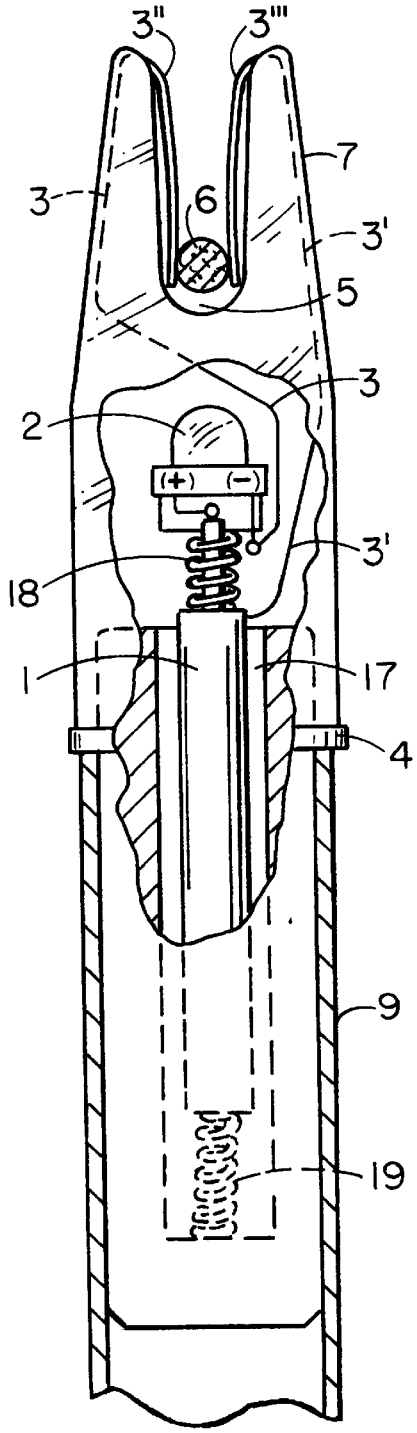
FIG. 2—On-off nock segment apparatus in "off" position or open switch.

FIG. 2 shows bow string 6in position to open the circuit by separating single pole switch contacts 3", 3'" thus there is no energizing of the LED bulb 2 when the bow string is placed in position in the nock slot 5 of nock 7 in readiness to shoot the arrow.

Figure 11:
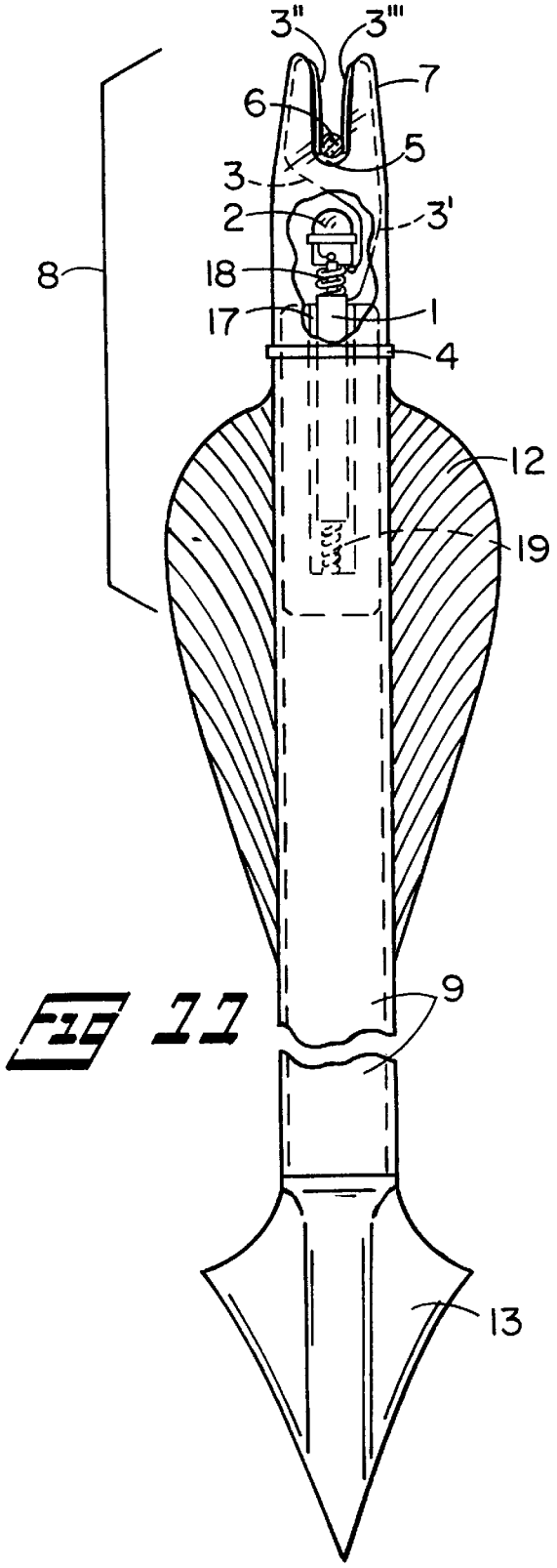
FIG. 11—Assembly of on-off lighted nock apparatus attached to hollow arrow shaft.

Reference is made to FIG. 11 to better show the relationship of the nock and LED assembly 8, and the fitting of this assembly 8 to the arrow shaft 9 on the end opposite the arrow head 13.

Figure 5A:
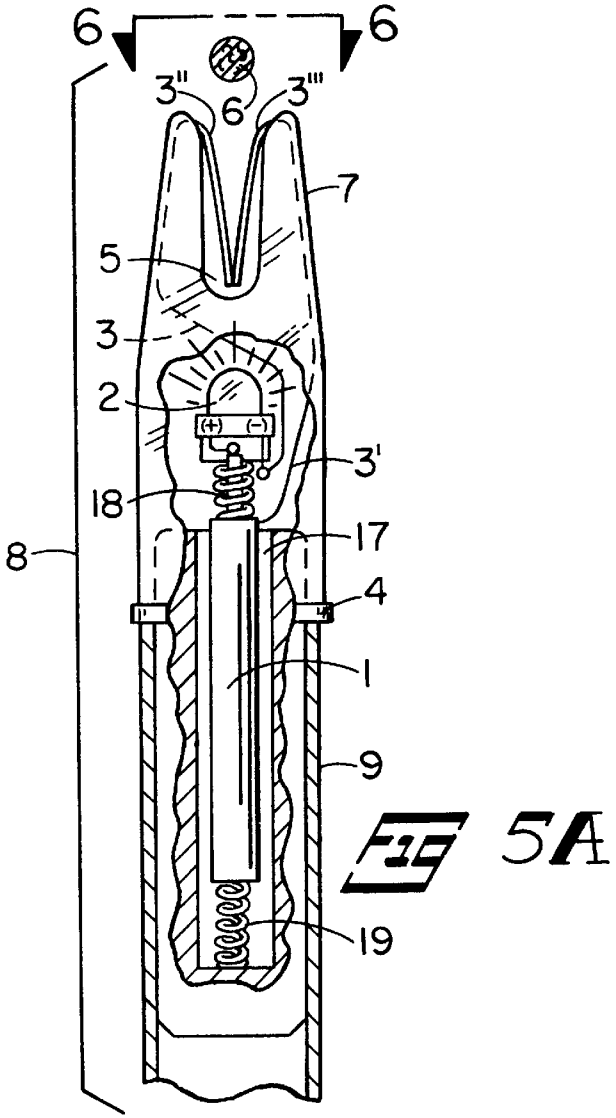
FIG. 5A—Expanded view of closed switch contacts after release of arrow.
Figure 5:
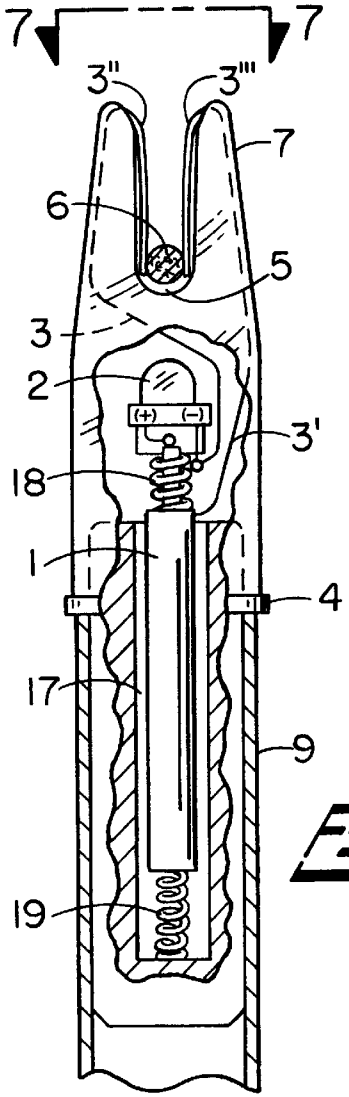
FIG. 5—Expanded view of contacts and arrow string at the bottom of the nock, set for release of arrow.

FIG. 5 shows expanded view of single pole switch contacts 3", 3'" and the arrow string 6 in nock slot 5 of nock 7, set for release of the arrow 20 from the bow. Bow string 6, is shown bottomed in the nock slot 5 of nock 7 and separating single pole switch contacts 3"–3'" each from the other to have an "open" switch, and the LED light bulb 2, is not energized.

FIG. 5A shows expanded view of single pole switch contacts 3"–3'" in closed switch position after release of arrow 20from a bow, with the contacts 3"–3'" each in contact with each other, as a closed switch.

It is to be pointed out that the single pole switch contacts 3"–3'" are of a spring type metal preferably stainless steel and are always in closed switch position unless separated by a bow string or other non-conductors of electricity, such as plastic of tongue 15 in a nock protective cap 14, placed over nock 7.

Figure 6:
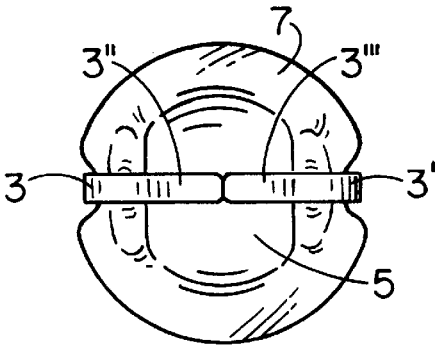
FIG. 6—End view of nock closed nock switch.
Figure 7:
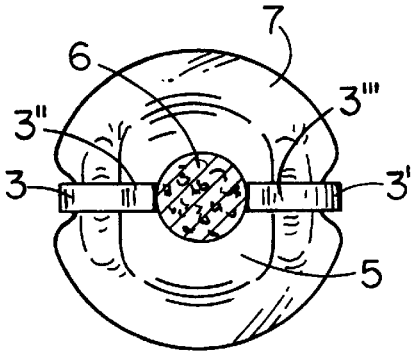
FIG. 7—End view of nock open switch.
Figure 8:
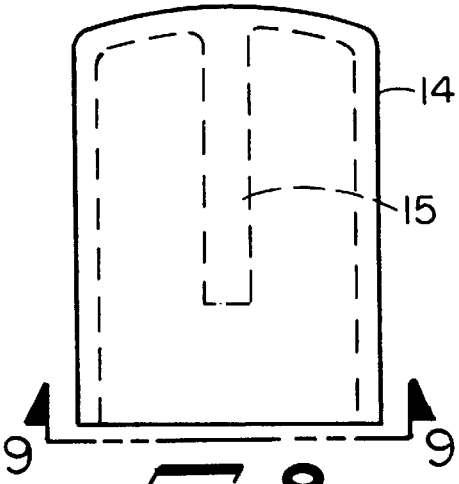
FIG. 8—Nock protective open switch cap.

FIGS. 6, and 7 are end views of the nock slots of FIGS. 5A and 5 respectively.

To insure that the battery energy is not spent when the arrows of this invention are not mounted in the bow, a nock protective cap 14, with a tongue 15 on the inside of the cap is mounted over the nock 7 and the tongue 15 in the nock protective cap 14 extends into the nock slot 5 to open the circuit by separating the single pole switch contacts 3", 3'" to then have an open switch.

This nock protecting cap 14 with tongue 15 pushes plunger of microswitch 11 down into microswitch 10 to "open" or "off" position when placed over the nock slot 5 of the nock-micro switch-LED assembly 8'.

Figure 9:
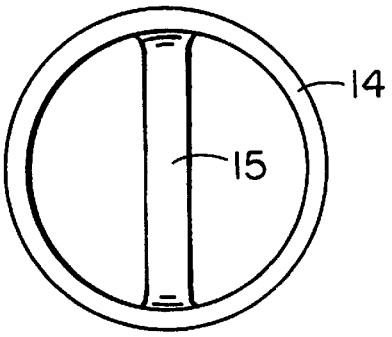
FIG. 9—Open end view of nock protective open switch cap.

FIG. 9 is open end view of nock protective open switch cap 14, showing tongue 15 in nock protective cap.

Figure 13:
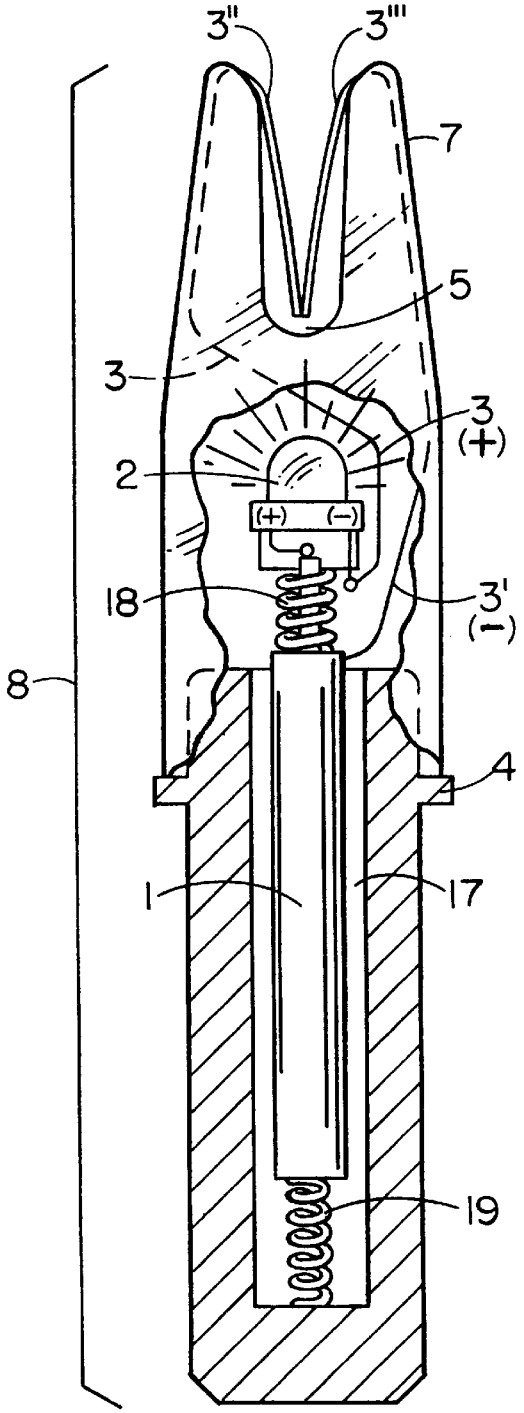
FIG. 13—Enlarged side view of on-off lighted nock assembly.
Figure 14:
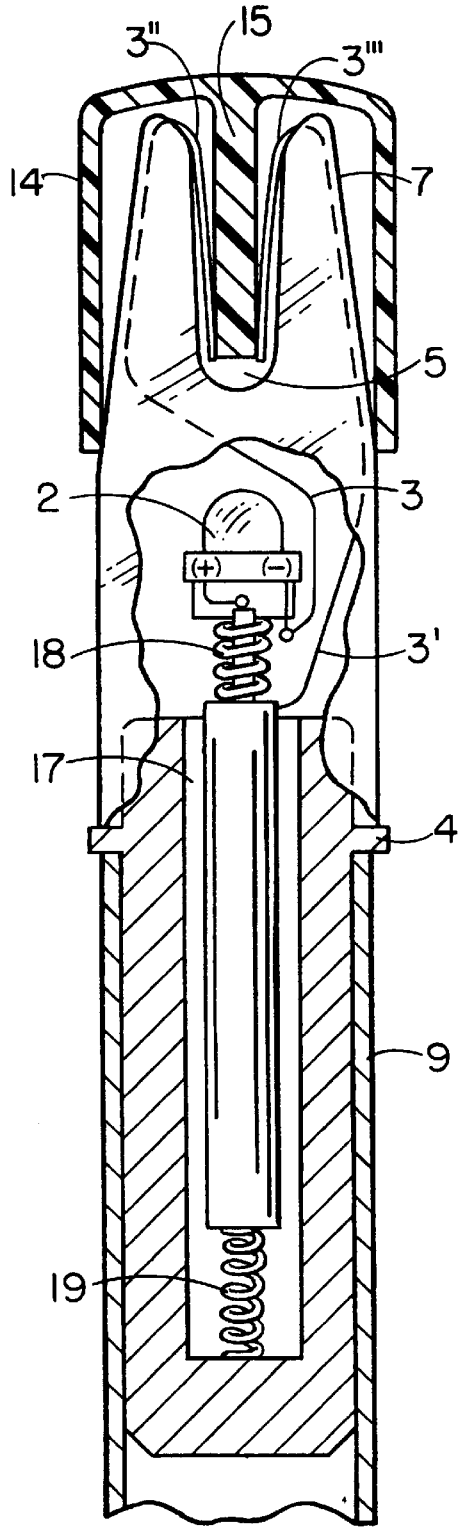
FIG. 14—Enlarged side view of off lighted nock assembly and nock protective cap in position over nock assembly.

The nock and LED bulb assembly 8, is shown in FIG. 13 and shows nock 7 abutting LED bulb 2, and battery 1 in battery holder 17, and a compression bottom spring 19 in the bottom of battery holder 17 supporting the battery 1, and a top coil spring 18 for the battery 1 and this spring 18 to be concentric to but not touching the positive (+) pin of battery 1, but this spring 18 contacts the negative (–) wall of battery 1, and electric contact lead 3' connects to spring 18 (–) and positive (+) pin of battery 1, connects to one contact of the LED bulb and contact lead 3 connects to another contact of the LED bulb and the leads 3, 3' extend to single pole switch contacts 3' and 3'" in nock slot 5 of nock 7, thus forming a single pole switch, and on contact of switch contacts 3" and 3'" to each other the switch is closed means the LED bulb 2 will be energized to give off a light, which shows through the transparent nock 7.

Figure 3:
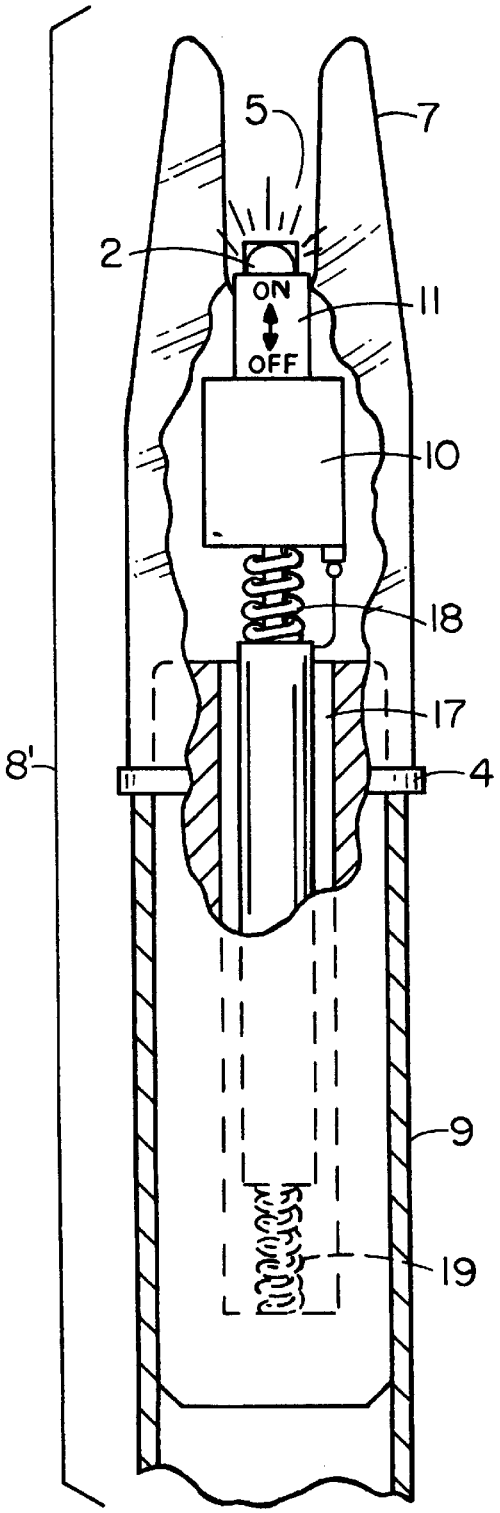
FIG. 3—On-off micro switch/LED apparatus with swatch in "on" or closed position.
Figure 3A:
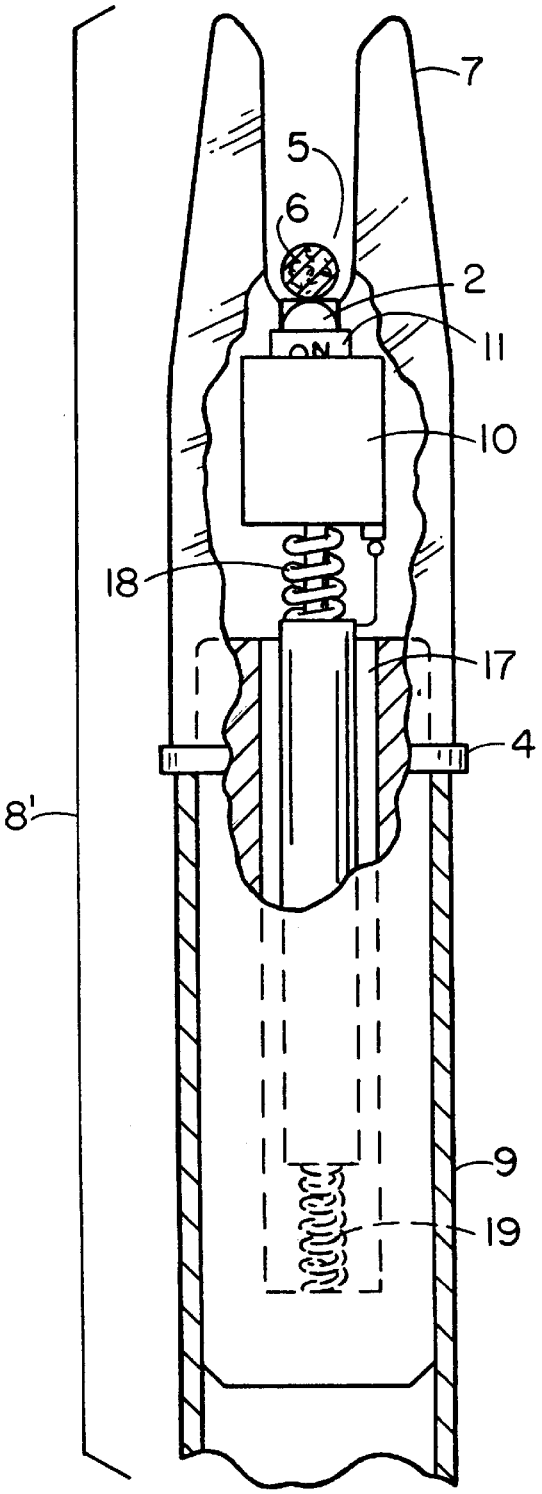
FIG. 3A—On-off micro switch/LED apparatus with switch in "off" or open position.

As an alternative to on-off switch contacts 3", 3'", reference is now made to FIGS. 3, 3A, to show a micro-switch 10, and battery 1 mounted under the nock 7, and a plunger 11 with LED light bulb 2 mounted on the outer end of the plunger 11, and this plunger 11 extends into micro-switch 10, and this assembly 8' mounted in the fletched end 12 of tubular metal arrow shaft 9, of arrow 20. Micro-switch 10 is always in the closed position with the plunger 11 of micro-switch 10 in full "out" extended position, to energize the LED light bulb 2, and on placing an arrow 20 in the archery bow, the bow string 6 in the nock slot 5 pushes plunger 11 into the "off" or open switch position, and on shooting the arrow 20 the switch is in "closed" position to energize the LED light bulb 2.

Figure 4:
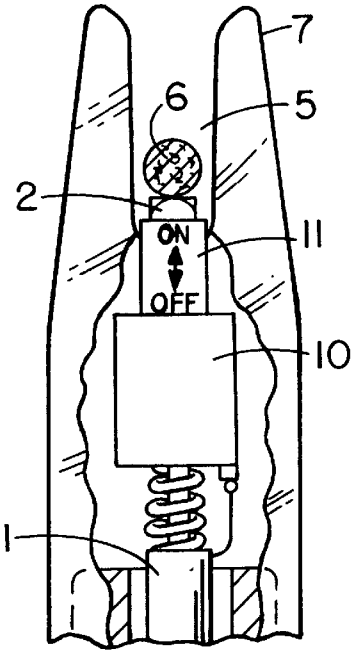
FIG. 4—Isolated drawing of micro switch, and on/off plunger.

FIG. 4, is a magnified side elevation view of nock-micro-switch-LED assembly.

FIG. 5, 5A is a magnified side elevation view of the nock and LED assembly isolated from the mounting in the arrow.

Figure 10:
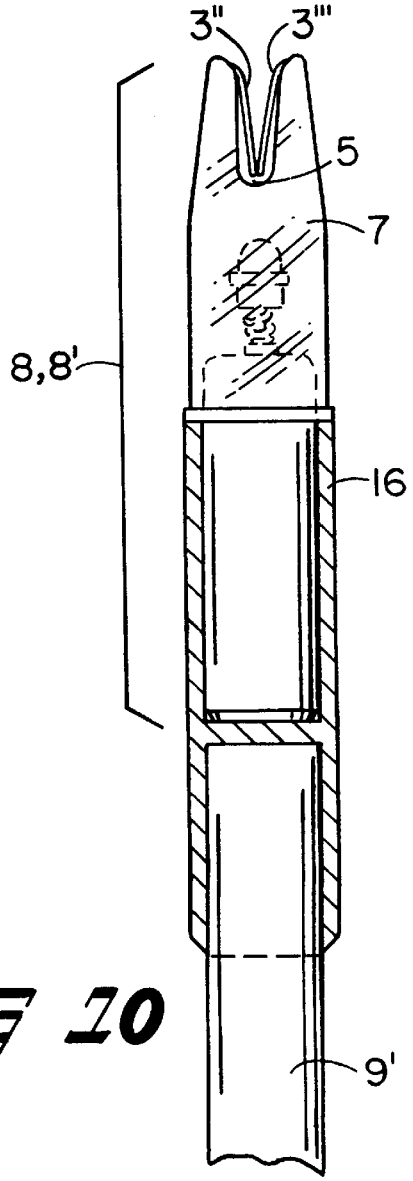
FIG. 10—Ferrule for joining on-off lighted nock segment to solid shaft or hollow shaft arrow.
Figure 15:
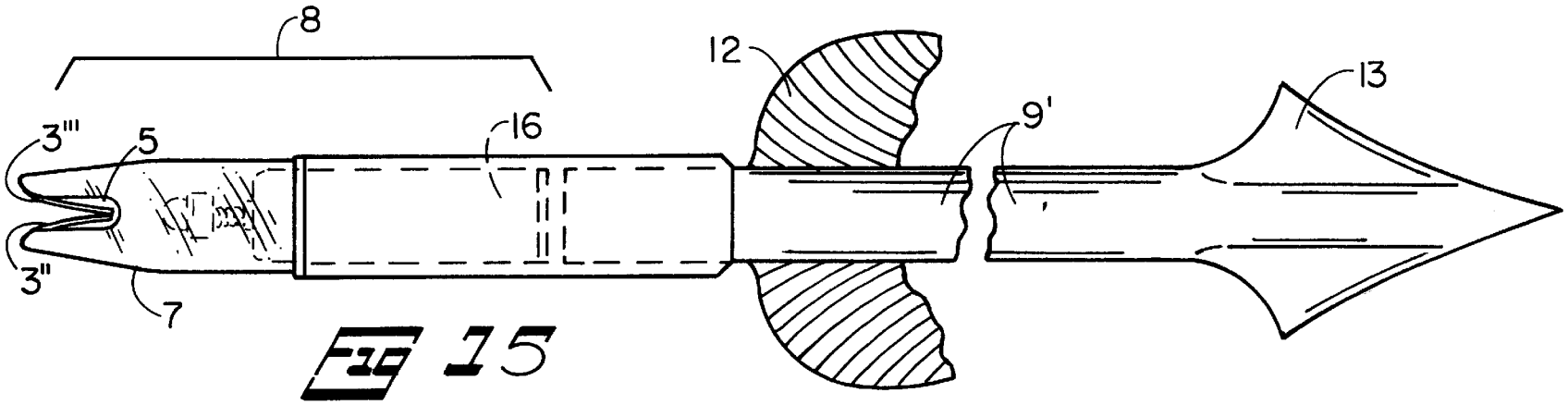
FIG. 15—Nock and LED assembly joined to solid shaft wood arrow by means of ferrule.

Nock and LED assembly 8, and nock-micro switch-LED assembly 8' can be fitted into a tubular metal arrow shaft 9, as discussed above and shown in FIG. 11, which shows assembly of on-off lighted nock apparatus attached to hollow arrow shaft, and FIG. 10 shows ferrule 16 for joining on-off lighted nock segment of 8 or 8' to solid shaft arrow, and is further illustrated in FIG. 15, and further nock and LED assembly 8 or 8' can be attached to a tubular metal arrow shaft 9 by use of the ferrule 16 mentioned above.

Figure 12:
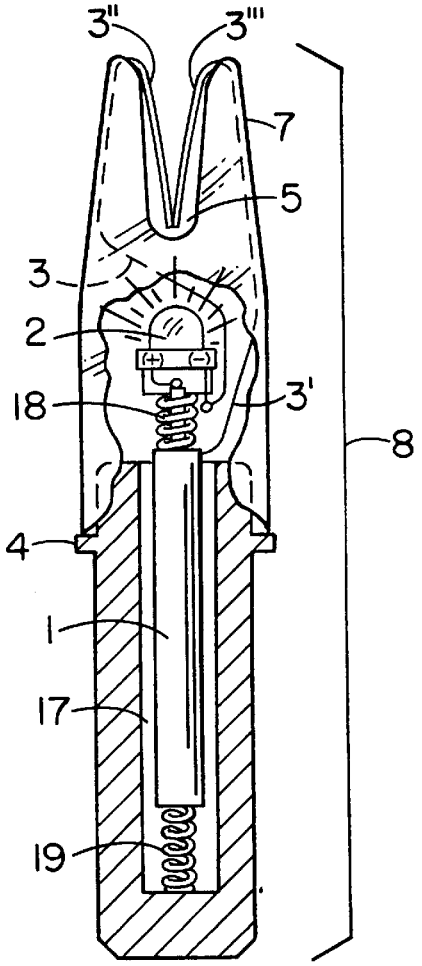
FIG. 12—Assembly of on-off lighted nock apparatus.

FIGS. 12 shows assembly of on-off lighted nock apparatus and FIG. 13 shows enlarged side view of on-off lighted nock assembly, which is an expanded view of the components.

In all of the above discussion the LED light bulb type can be identified as equal to or similar to HLMP 8100 supplied by Hewlett Packard Co. The battery type can be a Panasonic lithium 3.0 V., type BR435.

The nocks 7, discussed above may be molded of transparent or translucent plastic material or compound such as polyethylene, nylon, polycarbonate, polypropylene or glass as an alternative material.

The apparatus for controlled lighting of an archery arrow nock also includes an assembly 8 of said LED light bulb 2, single pole switch contact 3" and 3'", mounted in the nock 7, and a battery 1 connected to a contact 3" of the single pole switch, and to the LED light bulb 2 and, a ferrule 16 joining the assembly 8 to fletched end of shaft 9 or 9', of arrow 20.

As an alternate to the above, the nock-microswitch-LED-assembly 8' can be joined to the fletched end of shaft 9 or 9' of arrow 20 by means of a ferrule 16.

The word "fletched" is a derivative of the word "fletch" or "fletching" pertaining to feathers on shaft of an arrow.

Figure 16:
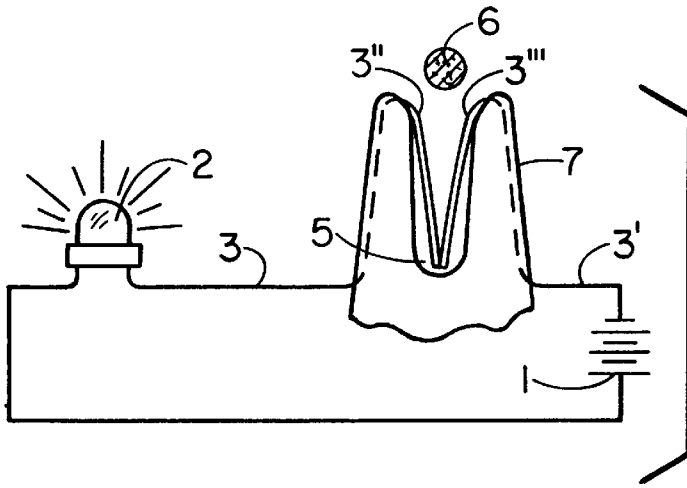
FIG. 16—Schematic of electric circuit, bow string and single pole switch in closed position in arrow nock slot.

To better illustrate the invention, reference is made to FIG. 16 showing the schematic of the electric circuit, showing the bow string 6 withdrawn from the nock 7, and single pole switch leads 3" and 3'" in closed position in arrow nock slot 5, and battery 1 positive pole (+) connected to one single pole 3'" contact of single pole switch, and negative pole (–) of battery 1 connected to one of two contacts of the LED light bulb 2, and the remaining contact of the LED light bulb 2 connected to single pole 3" of the switch.

Figure 17:
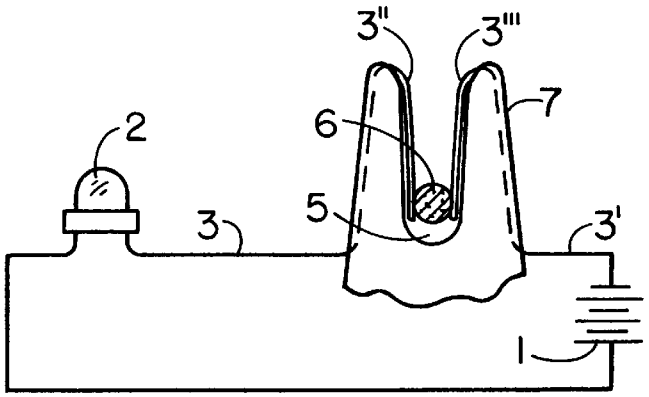
FIG. 17—Schematic of electric circuit, bow string and single pole switch in open position in arrow nock slot.

FIG. 17 is a schematic of electric circuit, showing bow string 6 in position to open, to "off" the switch 3" 3'" in the nock slot 5 of nock 7 de-energize the LED light bulb 2. The other components of the circuit are as described above for FIG. 16.

The switch contacts 3" and 3'" are always in contact in "closed" switch position except when in "open" position when the bow string 6 separates the switch contacts on mounting arrow 20 in the bow. The switch contacts 3" and 3'" can be set in open position independently of the bow by insertion of electrically insulating material in the nock slot 5, of nock 7, however it is preferable to place the nock protective cap 14 over the nock 7, and tongue 15 in nock protective cap extends into nock slot 5, to separate contacts 3" and 3'" to "open" switch position.

The nock protective cap 14, and tongue 15 in nock protective cap to be of transparent or translucent material, colorless or colored, preferably molded of plastic material, as shown above for the nock 7.

What is claimed is:

1. Apparatus for controlled lighting of an archery arrow nock, said arrow nock mounted to a tubular metal arrow shaft, said apparatus comprising:

a—an LED light bulb;

b—a switch comprising single pole switch contacts mounted in a slot of said nock, said switch contacts biased into contact with each other so the switch is normally in the "closed" or "on" position;

c—a battery;

d—an assembly of said LED light bulb and said single pole switch contacts mounted in said nock slot; said battery electrically connected to said single pole switch and to said LED light bulb;

e—said LED light bulb of said assembly butting up to the base of said nock;

f—said battery of said assembly extending into a battery holder pocket containing a compression spring to butt up to an end of said battery, and;

g—said battery holder of said assembly connected to the fletched end of said tubular metal arrow shaft.

2. Apparatus for controlled lighting of an archery arrow nock, of claim 1, wherein:

a—the positive pole of said battery connects to one lead of said LED light bulb;

b—the negative pole of said battery connects to an electric contact lead of one of said single pole switch contacts and, c—a contact lead from the other contact of said single pole switch extends to the LED remaining contact lead to energize the LED light bulb.

3. Apparatus for controlled lighting of an archery arrow nock, of claim 1, wherein:

a—said switch is moved to open position on separating said switch contacts by a bow string, on mounting of said apparatus attached to said arrow onto a bow.

4. Apparatus for controlled lighting of an archery arrow nock, of claim 1, wherein:

a—said nock is made of transparent or translucent plastic compound.

5. Apparatus for controlled lighting of an archery arrow nock, of claim 1, wherein:

a—said nock is molded of transparent or translucent, plastic material selected from the group consisting of nylon, polycarbonate, polyethylene, and polypropylene.

6. Apparatus for controlled lighting of an archery arrow nock, of claim 1, wherein:

a—said contacts in said nock slot of said arrow are changed to open switch position by a bow string fitting between said contacts in said nock slot of said arrow on mounting said archery arrow in a bow.

7. Apparatus for controlled lighting of an archery arrow nock, of claim 1, wherein:

a—a ferrule loins said nock to a fletched end of the shaft of the arrow.

8. Apparatus for controlled lighting of an archery arrow nock, of claim 1, further comprising:

a—a nock protective cap which can be placed over said nock and, b—a tongue in said nock protective cap extending downward into said nock to separate contacts of said single pole switch to open said switch.

9. Apparatus for controlled lighting of an archery arrow nock, of claim 8, wherein:

a—said nock protective cap is made of transparent or translucent plastic material selected from the group consisting of nylon, polycarbonate, polyethylene, and polypropylene.

10. Apparatus for controlled lighting of an archery arrow nock, of claim 1, further comprising:

a—a battery holder pocket shoulder on said battery holder pocket b—said battery holder pocket inserted up to said battery holder pocket shoulder into the fletched end of a tubular hollow metal arrow shaft, or a ferrule connecting to a solid arrow shaft.

11. Apparatus for controlled lighting of an archery arrow nock, said arrow nock mounted to a tubular metal arrow shaft, said nock having a slot having an open end and a base end, said apparatus comprising:

a plunger mounted in the base end of said nock slot, said plunger having an outer end having an LED light bulb visible through said nock slot, and an inner end connected to a micro switch;

a battery holder, containing a battery, mounted in said arrow shaft;

said battery electrically connected to said switch and said LED light bulb;

means to normally bias said plunger to a first position toward the open end of the nock slot;

said switch being in the "closed" or "on" position when said plunger is in said first position, thus completing a circuit between the battery and LED to illuminate the LED;

such that when the arrow is mounted onto an archery bow, the presence of a bow string within the nock slot will push the plunger inward toward a second position, said switch being in the "open" or "off" position when the plunger is in the second position, thus de-energizing the LED.

* * * * *

UNITED STATES PATENT AND TRADEMARK OFFICE

CERTIFICATE OF CORRECTION

PATENT NO. : 6,123,631
DATED : August 9, 1999
INVENTOR(S) : Jeffery A. Ginder

It is certified that error appears in the above-identified patent and that said Letters Patent is hereby corrected as shown below:

Column 6,
Line 53, the word "loins" is to be corrected to "joins".

Signed and Sealed this

Twenty-fifth Day of September, 2001

*Attest:*

Nicholas P. Godici

NICHOLAS P. GODICI
*Acting Director of the United States Patent and Trademark Office*

*Attesting Officer*